United States Patent [19]

Van Dolah

[11] 4,314,698

[45] Feb. 9, 1982

[54] ACTION SEQUENCING GAME

[76] Inventor: Diva Van Dolah, 318 N. Winthrop Cir., Mesa, Ariz. 85203

[21] Appl. No.: 132,189

[22] Filed: Mar. 20, 1980

[51] Int. Cl.[3] ..... A63F 9/00

[52] U.S. Cl. ..... 273/1 R; 273/146

[58] Field of Search ..... 273/1 R, 146, 93, 94, 273/1 G

[56] References Cited

U.S. PATENT DOCUMENTS

| | | | |
|---|---|---|---|
| 1,141,624 | 6/1915 | Fullerton | 273/94 R |
| 1,257,779 | 2/1918 | Anderson | 273/146 |
| 1,524,529 | 1/1925 | Allen | 273/146 U X |
| 1,702,760 | 2/1929 | Bradley | 273/146 |
| 3,208,754 | 9/1965 | Sieve | 273/146 |

*Primary Examiner*—Paul E. Shapiro

*Attorney, Agent, or Firm*—Don J. Flickinger

[57] ABSTRACT

A game for two or more players in which the players must rely on their ability to perform a prescribed set of movements of playing pieces in accordance with designated surfaces of said playing pieces at each of which surfaces is sensibly impressed at least a different one member of a recognizable sequential pattern. The recognizable sequential pattern is not limited to alphanumerics, but may be words taken from familiar limericks or poems, the vocalization of musical scales, or the like. Each player is given a playing piece. The pieces are passed to an adjacent player, one step at a time as all players recites out loud a member of the sequence. The playing pieces are passed with each sequence member recited until the member of sequence is the one appearing face up on the playing pieces at which point there is a hesitation in passing for one sequence count. The same pass and recite sequence is repeated, this time silently, and then again out loud and so on. Each time the sequence count is restarted the playing pieces are turned to the next higher sequence member. The players are penalized script money for errors in passing or turning the playing piece, or vocalizing the sequence. The player having the most money at the end of the final sequence count is the winner.

5 Claims, 9 Drawing Figures

ACTION SEQUENCING GAME

BACKGROUND OF THE INVENTION

1. Field of the Invention

The invention relates to a game in which the players move a playing piece through a predetermined sequence of actions. In particular, the invention relates to a game having a playing piece bearing sensibly recognizable members of a known patterned sequence, the playing piece being moved through a programmed sequence of action while the players recite, vocally or silently, the recognized pattern sequence.

2. Prior Art

The history of games is probably older than the recorded history of man. The "mancala" or pit-and-pebble games are said to have been known and played for over 3500 years and probably originated in Egypt or Arabia. The pit-and-pebble games prescribed a sequence of actions on the part of the players whereby pebbles were sown among two facing ranks of six shallow pits and an opponents pebbles were captured when a prescribed number of pebbles remained in given pits after each sowing.

With games such as chess and checkers, the movements of the playing pieces are prescribed but the manner in which each movement is initiated is determined by the skill and experience of the player moving a given piece.

Board games, such as Parker Brothers' MONOPOLY, have the sequence of actions determined by the chance throw of dice and the independent buy-or-sell determination of the player. Despite the long ancient history of games, a search of the prior art could uncover no game which required its players to recognize a known sequential pattern, which pattern may be vocalized, and to move a playing piece through a pre-established sequence of moves while the recognized sequential pattern was recited by the players either aloud or silently.

It is therefore an objective of the invention to provide a game which does not depend upon the individual initiative action of any one or more players.

It is a further objective of the invention to provide a game in which the movements are not dictated by chance.

It is another objective of the invention to provide a game wherein the players move, essentially in unison, through a prescribed series of movements of playing pieces and wherein players are penalized for failure to perform the prescribed sequence of movements.

It is a specific objective of the invention to provide a game in which the players only preparation lies in their ability to recognize and vocalize a sequential pattern, said vocalization taking place either aloud or silently while a playing piece is moved by each participant through a prescribed sequence of movements.

SUMMARY OF THE INVENTION

The invention is a game for two or more players and comprises at least one playing piece per player. Each playing piece has a plurality of surfaces. The surfaces are each provided with means to sensibly communicate to the players, permitting the players to recognize, on each of the surfaces of said playing pieces, at least a different one member of a recognizable sequential pattern. The players will recognize that the sequential pattern may be readily vocalized by them and that at least alternate members of the recognizable sequential pattern have been omitted from the playing pieces. At the start of play, a particular surface is designated to control the movement of the game. Play begins with the players vocalizing aloud each member of the recognizable sequential pattern communicated to the players from the surfaces of the playing piece. As each member of the recognized sequential pattern is recited, the playing piece is passed by a moving player to the player adjacent to him. When the member of the sequential pattern being recited agrees with the member of the sequential pattern on the designated surface of the playing piece, a hesitation movement occurs wherein the moving player does not release the playing piece to the adjacent player but instead, returns it to himself while the next member of the recognized sequential pattern is recited following which the playing piece is passed and released to the adjacent player. This prescribes the basic movement of the game. Immediately following the hesitation movement just described, a variation in play takes effect.

While performing the basic movements set forth above, the players recited aloud each member of the recognized sequential pattern. This audible recitation of the sequential pattern continued until the hesitation movement was completed and the playing piece passed and released to the adjacent player. At this point in the action, all audible recitation ceases while each player beings anew a silent vocalization of each member of the recognized sequential pattern until once again called upon to perform another hesitation movement as the silent recitation vocalizes the member of the sequential pattern which agrees with that on the designated surface of the playing piece. When this occurs, the hesitation movement is modified to include a re-orientation of the playing piece so as to designate a new surface and therefore a new member of the recognized sequential pattern.

Play now continues with an audible vocalization of each member of the recognized sequential pattern. The audible vocalization terminating in a hesitation movement which is initiated when the audible recitation agrees with the member of the sequential pattern communicated on the newly designated surface of the playing piece. A similar silent vocalization phase of the game then ensues which terminates following the hesitation movement with a re-orientation of the playing piece so that a new designated surface and a new designated member of the recognized sequential pattern is presented to the players.

Play continues until the playing piece has been finally re-oriented to present the remaining surface of the playing piece to the players.

The play may involve the use of script money with each player forfeiting a designated amount of script money each time the player makes a mistake by failing to recite silently during the silent recitation portion or audibly during the audible recitation portion or by failing to hesitate during either of the hesitation movements or finally by failing to re-orient the playing piece at the end of the hesitation movement in the silent recitation portion of play. Bankrupt players are ousted from play. If more than one plyer remains at the end of the game, that player having the largest amount of script money is declared the winner.

BRIEF DESCRIPTION OF THE DRAWINGS

FIG. 1 illustrates a playing piece in the form of a cube illustrating a sequence of odd numbers sensibly impressed upon the various surfaces of the cube.

FIG. 2 is an expanded view of the surfaces of the cube of FIG. 1 showing the odd numbered sequence 5 through 11 sensibly impressed on the side faces of the cube while the odd number 13 is duplicated on the top and bottom faces.

FIG. 3 is an expanded view of a cube similar to that of FIG. 2 but instead of duplicating the odd number 13 on both top and bottom faces, the number 13 appears on the top face and 15 is sensibly impressed upon the lower face.

FIG. 4 illustrates a cubical playing piece similar to that of FIG. 1; however, in this instance, letters of the alphabet are sensibly impressed upon the surfaces of the cube.

FIG. 5 illustrates the cube of FIG. 1 expanded to show all of its surfaces. Side surfaces 24 have the letters F, H, J, and L sensibly impressed thereon while the letter N is duplicated on top and bottom surfaces.

FIG. 6 represents the expanded view of a block similar to that illustrated in FIG. 1 and FIG. 4. However, instead of an alpha or numeric sensible impression on the surfaces of the cube, the playing piece of FIG. 4 contains the words Hickory, Dock, Mouse, Up on its side faces and the word Clock duplicated on top and bottom faces. The players will recognize that the words sensibly impressed upon the surfaces of the block of FIG. 6 are members of the sequential pattern "Hickory dickory dock, the mouse ran up the clock".

FIG. 7 suggests an alternate shape for a playing piece, a pyramid having three sides and a base all of which are triangular and congruent.

FIG. 8 is an expanded view of the surfaces of the pyramid of FIG. 7. In this figure, the numerals 6, 8 and 10 are sensibly impressed upon the side surfaces while the numeral 12 is impressed upon the base surface.

FIG. 9 is an expansion of a pyramidal playing piece such as illustrated in FIG. 7; however, in this instance the side surfaces are sensibly impressed with the scalar notations do, me, so, ti. The players will recognize these as being members of the sequential pattern of the musical scale vocalized as "do, ra, me, fa, so, la, ti, do".

DETAILED DESCRIPTION OF THE INVENTION

The invention is a game played by two or more players. Each player receives a playing piece. There is a multiplicity of surfaces on the playing piece, on which surfaces are sensibly impressed members of a recognizable sequential pattern. By sensibly impressed, it is meant that a player may discern the member of the recognizable sequential pattern using one or more of his senses. Thus, a numeral painted on a surface of the playing piece will appeal to the visual senses of the player. Embossed or engraved markings may appeal to both the visual as well as the tactile senses of the player. Any impression upon the playing piece which permits a player to utilize one or more of his senses to discern the member of the sequential pattern presented upon a given surface of the playing piece will satisfy the requirement that the member of the sequential pattern be sensibly impressed on the surface of the playing piece.

Figure 1:
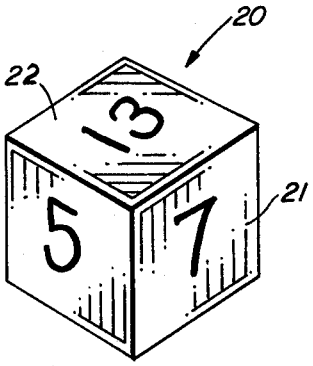
FIGS. 1–9 are all concerned with illustrating various embodiments of playing pieces to be utilized with the invention. These various embodiments are offered by way of illustration and are not to be considered limitations upon the form of either the playing piece or the recognizable sequential pattern which is sensibly impressed upon the surfaces of said playing pieces.
Figure 2:
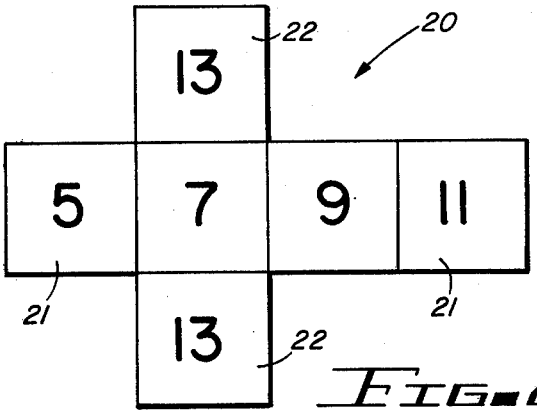

Considering the illustrations of FIGS. 1 and 2, the players will readily recognize that the numbers impressed upon the surfaces of cube 20 which bears the numbers 5, 7, 9 and 11 on side faces 21, and duplicates the number 13 on side faces 22; represents the sequential pattern of numbers running from 1 through 13. For purposes of playing the game, the fact that the numbers also repesent the subset of odd-numbers from 1 through 13 will be disregarded.

It is seen that in the sequence of numbers selected, 1 through 13, the alternate members of that sequence lying between 5 and 13 have been omitted from the surfaces of playing piece 20. The playing of the game involves a sequence of programmed movements of the playing pieces. The omission of the even numbers in the recognized sequential pattern 5 through 13, permits the execution of what is denoted herein as "the hesitation sequence" in the prescribed sequence of movement of the playing piece.

With reference to FIGS. 1 and 2, illustrating playing piece 20 in cubical form, the following description represents the method of playing the game which is the subject of this disclosure.

Each person playing receives five pieces of script money and one playing piece 20. Playing pieces 20 are cubical and each side bears a number. Assume that four sides 21 of the cube 20 bear different numbers and that two sides 22 each have the same number. Assume further that the numbers sensibly impressed on playing piece 20 are 5, 7, 9, 11 with the addition of the duplicated 13 on two sides 22.

Each person faces piece 20 in front of them with the number 5 on top. As the game commences, each person takes the piece 20 before him and passes it to the person on the right. All participants count aloud as each piece 20 is passed. Thus, on the count of one, the piece 20 in front of the player is passed to the player on his right. At the count of two, the piece 20 that has now appeared in front of the player from the player on his left, is picked up and passed to the player on the right. This is repeated for the counts of three, four, and five, five being the number which is face up on piece 20. At the count of five, although piece 20 is passed to the right, it is not released but is brought back to the player for the count of six and then passed to the right for the count of seven. At this point in the game, the number 5 remains on top of the block.

The foregoing sequence of actions is now repeated, with one important exception. That is, each player must count silently as the pieces 20 are passed to the right. Once again, when the count of 5 is (silently) reached, piece 20 is passed to the player on the right but not released to that player. It is returned to the person holding the piece 20 for the silent count of six and then passed to the right for the silient count of seven. This time, it is important that piece 20 be rotated so that the number 7 appears face up when piece 20 is released to the player on the right.

If a player forgets to count silently during the repeated sequence, all play stops and the forgetful player is penalized by having to deposit a piece of script money in the pot. All play then returns to the initial sequence just as described above. Upon completion of the silent sequence, if a player forgets to rotate piece 20 so as to present the next sequential number written on the faces of piece 20, play again stops. The forgetful player is again penalized one piece of script money and play again returns to its initial starting point.

Once all of the players have successfully completed the vocal counting sequence, and the silent counting sequence, and rotated the pieces 20 so that the 7 is face up, play resumes with a vocal counting sequence similar to that of the first phase of action. Now, however, as piece 20 is passed to the right, each player counts aloud, until the number 7 is reached, 7 being the number face up on the pieces 20 now being moved. At the count of seven, piece 20 is passed to the player on the right but is not released. Instead, it is returned to the moving player for the count of eight before being passed to the right and released for the count of nine. The silent sequence of action is now initiated. The count is reinitiated silently, beginning at the count of one, and continues once more until the face up number on piece 20, 7 in this instance, is reached. At that time, piece 20 is not released to the player on the right. Instead, it is passed to him siliently on the count of seven, returned silently to the moving player for the count of eight, and then passed back and released to the player on the right for the silent count of nine, at which time piece 20 must once more be rotated, this time bringing the numeral 9 face up before the player on the right. As before, failure to rotate piece 20 or failure to count aloud or silently in the proper sequence, causes the player forgetting to act properly to be penalized and the game to return to the initial sequence.

In this manner, the game continues. A sequence of vocal counts is followed by a sequence of silent counts. At the end of the silent sequence, the pieces 20 are rotated to bring a new number face up on piece 20 as it is passed to the player on the right. In the course of counting, both vocally and silently, when the number which is face up on piece 20 is reached, piece 20 is not released to the player on the right but is returned to the moving player's position for the next count and then passed and released to the player on the right. At that time, if the sequence being played is a vocal sequence, piece 20 is not rotated. However, if the sequence being played is a silent sequence, piece 20 must be rotated to bring the next playing number to the top of the piece as it lies in front of the player to the right.

Play continues until the final number, 13, in the sequence of numbers sensibly impressed on piece 20 is reached. Players are eliminated when they lose all of their script money, at which time their playing piece 20 is removed from the table and the bankrupt player no longer participates in the play. If all but one player is thus eliminated, the remaining player is the winner. Should play continue until the highest number in the sequence on the playing piece 20 is reached, the Magic Number, and more than one player remains in the game, the player having the largest amount of money in his bankroll wins the pot. Other variations are, of course, possible such as permitting the players to split the pot equally. Should the magic number be reached with more than one player remaining in the game, the sequence of play begins anew until only one player remains or the came is called by mutual agreement with the player having the largest amount of money in his bankroll being declared the winner.

The game is best played to be appreciated. The hesitation sequence which occurs each time the count reaches the number which is face up on playing piece 20 lends itself to spontaneous hilarity amongst the players. Despite the greatest concentration by the player, it proves foolishly simple to forget to count silently when the silent sequence is reached or to commence the vocal count when the next vocal sequence is reached. So too, the fact that the playing piece 20 being moved must be rotated to bring the next number in the sequence face up at the end of a silent count rather than at the end of a vocal count can prove an insurmountable obstacle for certain players.

Figure 3:
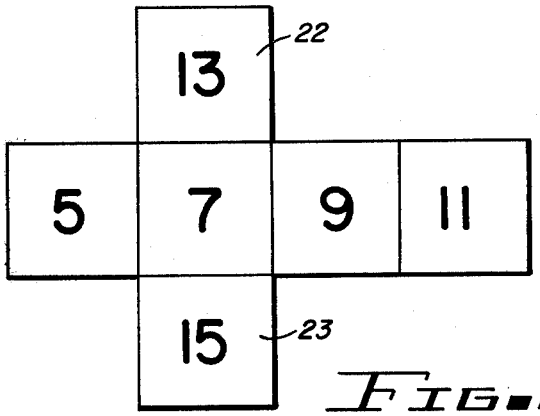

In the playing piece 20 chosen to illustrate the method of play, the number 13 was duplicated on faces 22. Such duplication is not necessary, as shown in FIG. 3. Whereas the numbers 5, 7, 9, 11 and 13 have been chosen in this example, any appropriate sequence of numbers or letters or words may be utilized, as will now be disclosed.

Figure 4:
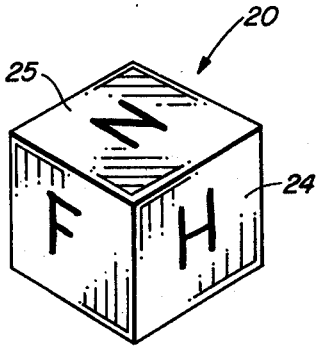
Figure 5:
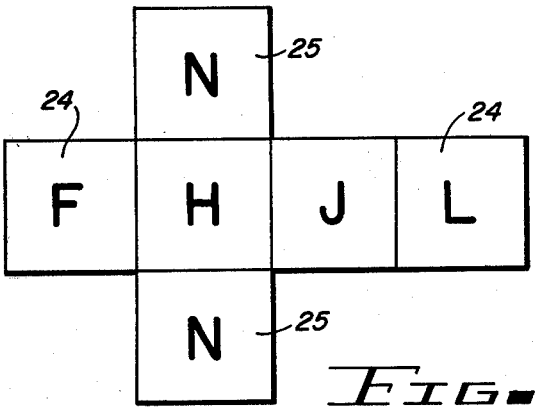

In FIG. 4, a playing piece in the shape of a cube 20 is illustrated having side faces 24 and top and bottom faces 25. As seen more clearly in FIG. 5, wherein the surfaces of playing piece 20 are expanded, the letters F, H, J and L are sensibly impressed on side faces 24 of cube 20 while the letter N is duplicated on top and bottom faces 25. It is easily reconized that this is part of the sequence of letters between A and N with the alternate members of that sequence G, I, K and M, omitted. With this playing piece, the game is played as aforedescribed with the hesitation sequence being initiated when the letter in the alphabet is reached in the course of vocalizing the sequence, which letter is face up on the cube at the time it coincides with the vocalized letter.

Figure 6:
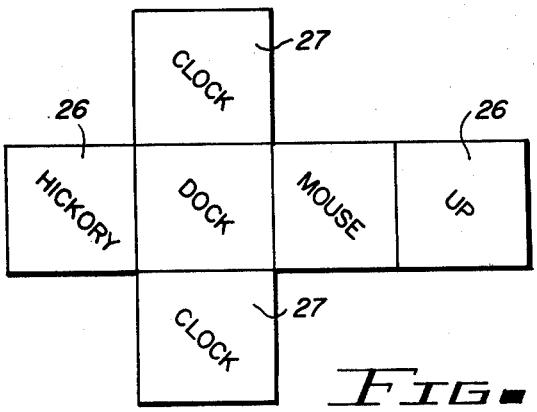

FIG. 6 illustrates an expanded cubical playing piece having side surfaces 26 and top and bottom surfaces 27. In this instance, side surfaces 26 are impressed with the words, Hickory, Dock, Mouse, Up, while the word Clock is duplicated on top aand bottom surfaces 27. The players will recognize that the words sensibly impressed upon the surfaces of playing piece 20 in this instance are part of the sequential pattern "Hickory dickory dock, the mouse ran up the clock". With this playing piece, the hesitation sequence begins with the initial movement of the playing piece since the first word of the recognizable sequential pattern coincides with the initial face-up surface of the block.

Figure 7:
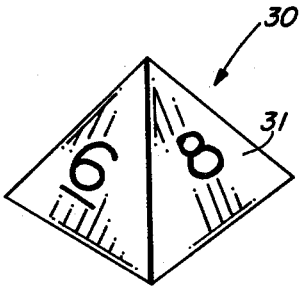

It should be emphasized here that the shape of the playing piece is not limited to a cube but may be any polyhedron having sufficient surfaces to match the required complexity of the game. To emphasize this fact, pyramidal playing piece 30, having three triangular sizes and one triangular base all of which are congruent, is illustrated in FIG. 7. The pyramidal playing piece offers an additional challenging fillip to the players of the game in that, unlike the cubical playing piece 20, the designated surface of the pyramidal playing piece 30 which bears the impression of the member of the sequential pattern at which the hesitation sequence of the game is initiated, is placed face down in the course of play rather than face upward as was true of the cubical playing piece 20.

Figure 8:
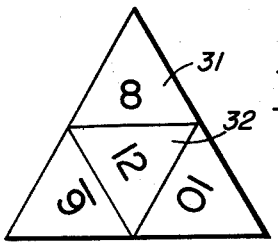

The pyramid of playing piece 30 is expanded in FIG. 8 to illustrate the numerical impressions 6, 8, and 10 on side surfaces 31 and the numeral 12 on base 32. The game proceeds as noted hereinbefore with the exception that the designated surface bearing the member of the sequential pattern at which the hesitation sequence is initiated, is placed face down rather than face up as indicated in the foregoing instructions.

Figure 9:
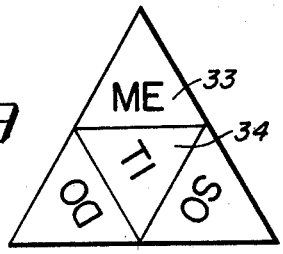

An expanded pyramidal playing piece 30 is illustrated in FIG. 9 bearing sensible impressions which will be recognized by the players as being members of the sequential pattern of the vocalized musical scale, "do, ra, me, fa, so, la, ti, do". As with the playing piece of FIG. 6, the hesitation sequence is initiated with the first movement of the playing piece since the designated surface "do" agrees with the vocalization of the first member of the musical scale pattern.

What I have described is a game for two or more players in which the players must rely on their ability to perform a prescribed set of movements of playing pieces in accordance with designated surfaces of said playing pieces at each of which surfaces is sensibly impressed at least a different one member of a recognizable sequential pattern. The game requires alertness on the part of the players. Any distraction will cause a player to fail to vocalize the sequential pattern in the prescribed manner or to move the piece in the proper sequence. The recognizable sequential pattern is not limited to alpha-numerics, but may be words taken from familiar limericks or poems, the vocalization of musical scales, or the like.

Those skilled in the art will recognize other variations of the game and embodiments of the playing piece such as is not specifically disclosed within the specification but which fall within the spirit and scope of the invention as is sought to be protected within the accompanying claims.

Having described my invention in such clear and concise terms in the above disclosure and in the accompanying drawings that those skilled in the art may readily understand and easily practice the invention, that which I claim is:

1. A method for playing a game with two or more players each of whom has a playing piece having a plurality of surfaces, upon each of which surfaces sensibly appear at least a different one member of a recognizable sequential pattern, at least alternate members of said recognizable sequential pattern being omitted, comprising the steps of:

(a) issuing a playing piece to each player;

(b) vocalizing said recognizable sequential pattern by all players as each player passes a playing piece to an adjacent player as each member of the sequential pattern is vocalized;

(c) hesitating in the passage of said playing piece as the member of said sequential pattern sensibly appearing on a designated surface of said playing piece is reached in the vocalization of said sequential pattern whereby the piece is not released to the adjacent player but is returned to the passing player as the next member of said sequential pattern is vocalized, the piece being actually passed to the adjacent player upon vocalization of the next following selected member of said sequential pattern;

(d) repeating the sequence of steps (b) and (c) while each player silently vocalizes said recognizable sequential pattern;

(e) designating a new surface of said playing piece indicative of another member of said sequential pattern as sensibly appears on said newly designated surface and thereby designating a new member of said sequential pattern at which the hesitating movement set forth in step (c) shall be initiated;

(f) repeating steps (b) through (e) until all-but-one surface of said playing pieces has been designated and the play advanced to a final repetition of step (d); and (g) designating the remaining surface of said playing piece to indicate end of play.

2. The method of claim 1 wherein the failure of one or more players to abide by the method of play set forth therein results in penalizing said player or players and returns play to a designated step (a) in the sequence of steps of play.

3. The method of claim 2 wherein the designated step (a) to which play is returned is the initial step (a) at which playing first began.

4. The method of claim 2 wherein each player is issued script money and the penalty for failure to abide by the method of play prescribed is the forfeiture of a designated amount of said script money.

5. The method of claim 4 wherein forfeiture of all money so issued to a player results in said player's ouster from said game.

* * * * *